US007434408B2

(12) United States Patent
Suzuki et al.

(10) Patent No.: US 7,434,408 B2
(45) Date of Patent: Oct. 14, 2008

(54) METHOD FOR COOLING AN ARTICLE USING A CRYOCOOLER AND CRYOCOOLER

(75) Inventors: Toshikazu Suzuki, Tsukuba (JP); Takakazu Shintomi, Tsukuba (JP); Takayuki Tomaru, Tsukuba (JP); Tomiyoshi Haruyama, Tsukuba (JP)

(73) Assignee: High Energy Accelerator Research Organization, Tsukuba (JP)

( * ) Notice: Subject to any disclaimer, the term of this patent is extended or adjusted under 35 U.S.C. 154(b) by 266 days.

(21) Appl. No.: 10/890,122

(22) Filed: Jul. 14, 2004

(65) Prior Publication Data

US 2005/0050904 A1 Mar. 10, 2005

Related U.S. Application Data

(60) Provisional application No. 60/539,542, filed on Jan. 28, 2004.

(30) Foreign Application Priority Data

Jul. 31, 2003 (JP) ..... 2003-204710

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | | |
|---|---|---|---|---|---|
| 4,375,749 | A * | 3/1983 | Ishizaki | 62/6 |
| 5,056,317 | A | 10/1991 | Stetson | |
| 5,582,013 | A | 12/1996 | Neufeld | |
| 5,647,218 | A * | 7/1997 | Kuriyama et al. | 62/6 |
| 5,647,219 | A * | 7/1997 | Rattray et al. | 62/6 |
| 6,343,475 | B1 * | 2/2002 | Ishikawa | 62/6 |
| 2002/0134089 | A1 | 9/2002 | Rudick | |
| 2005/0028534 | A1 * | 2/2005 | Li et al. | 62/6 |

FOREIGN PATENT DOCUMENTS

| | | | |
|---|---|---|---|
| DE | 38 36 959 | A | 5/1990 |
| EP | 0 311 726 | A1 | 11/1987 |
| FR | 2 750 481 | A | 1/1998 |
| JP | 02-029556 | A | 1/1990 |
| JP | A 02-309174 | | 12/1990 |
| JP | A 2000-292022 | | 10/2000 |
| JP | 2002-106993 | * | 4/2002 |
| JP | A 2003-075004 | | 3/2003 |

* cited by examiner

*Primary Examiner*—William C Doerrler
(74) *Attorney, Agent, or Firm*—Oliff & Berridge, PLC

(57) ABSTRACT

A stationary point is set on a cold end of a cryocooler. An article is mounted on the stationary point to be cooled via the stationary point. In this case, the article can be cooled up to an extremely low temperature with isolation of vibration to the article.

8 Claims, 4 Drawing Sheets

T : Period

METHOD FOR COOLING AN ARTICLE USING A CRYOCOOLER AND CRYOCOOLER

BACKGROUND OF THE INVENTION

1. Field of the Invention

This invention relates to a method for cooling an article using a cryocooler and the cryocooler.

2. Description of the Related Art

In a superconducting filter of IT communication field, a superconducting MRI of medical field, or in fundamental scientific field, it is required to cool a high precise electron microscope or a high performance precise instrument such as a high sensitivity submillimeter wave detector or an infrared ray detector to eliminate thermal disturbances therefrom. In cooling such a high performance precise instrument as mentioned above, as of now, a liquefied gas or a cryocooler is employed. Recently, the cooling temperature range of the cryocooler is improved down to 4K, which can be easily operated by pushing a button and in the past, can be realized only by using an extremely low temperature cryogen.

FIG. 1 is a structural view schematically illustrating a conventional GM (Gifford McMahon) type cryocooler. The cryocooler 10 illustrated in FIG. 1 includes a compressor 11 and a cryocooler cold head 12. In the cryocooler cold head 12 are provided a regenerator 13 and a displacer 14, and at the bottom in the cryocooler cold head 12 is provided a cold end 16. The combination of the regenerator 13 and the displacer 14 is called as a cooling cylinder. A high pressure gas and a low pressure gas are supplied to the cryocooler cold head 12 from the compressor 11 through the flexible hoses 15 and via the switching valve 17, compressed and expanded at the cryocooler cold head 12.

At the displacer 14, cooling power is created through the expansion of the gas to be synchronized with the expansion of the gas at the next stage by operating the motor 18. The coolant is repeatedly created through a plurality of expansions of the gas, and the thus obtained cooling power is are stored in the regenerator 13. As a result, the cold end 16 is cooled down to an extremely low temperature. An article is contacted with the cold end 16 to be cooled.

FIG. 2 is a structural view schematically illustrating a pulse tube type cryocooler. The cryocooler illustrated in FIG. 2 includes a compressor 21 and a cryocooler cold head 22. In the cryocooler cold head 22 are provided a regenerator 23 and a pulse tube 24, and at the bottom in the cryocooler cold head 22 is provided a cold end 26. The combination of the regenerator 23 and the pulse tube 24 is called as a cooling cylinder. A high pressure gas and a low pressure gas are supplied to the cryocooler cold head 12 from the compressor 21 through the flexible hoses 25 and via the switching valve 27, compressed and expanded at the cryocooler cold head 22.

At the pulse tube 24, cooling power is created through the expansion of the gas to be synchronized with the expansion of the gas at the next stage by operating the switching valve. The gas expansion is carried out by controlling the introduction timing of the gas into a buffer tank 28, which is successive to the pulse tube 24, via an orifice 29. The cooling power is repeatedly created through a plurality of expansions of the gas, and the thus obtained cooling power is stored in the regenerator 23. As a result, the cold end 26 is cooled down to an extremely low temperature. An article is contacted with the cold end 26 to be cooled.

In both of the GM type cryocooler and the pulse tube type cryocooler, since the high pressure gas and the low pressure gas, which are supplied from the compressors 11 and 21, are circulated in the cryocooler cold heads 12 and 22, the cold ends 16 and 26 are vibrated inevitably by an amplitude of about 10 μm in the axial directions thereof. The allowable limit in vibration of the high performance precise instrument is within a range of submicro-meter, so that if a relatively large vibration is applied to the precise instrument, the inner structure and the conrollability of the precise instrument may be destroyed, so that the precise instrument may malfunction.

SUMMERY OF THE INVENTION

It is an object of the present invention to cool an article such as a high performance precise instrument up to an extremely low temperature without the application of vibration to the article.

In order to achieve the above object, this invention relates to a method for cooling an article using a cryocooler, comprising the steps of:

setting a stationary point on a cold end of a cryocooler, and mounting an article onto the stationary point to be cooled via the stationary point.

The inventors had intensely studied to achieve the above-mentioned object. As a result, they found out the following fact.

The cold end is formed in circular shape, and two pairs of cooling cylinders are arranged on the main surface of the cold end so that the diagonal line connecting one pair of cooling cylinders is orthogonal to the diagonal line connecting the other pair of cooling cylinders. Then, a high pressure gas is supplied to the one pair of cooling cylinders, and a low pressure gas is supplied to the other pair of cooling cylinders. In this case, the shape of the cold end is deformed as shown in FIG. 3. As is apparent from FIG. 3, although the shape of the cold end is changed with time, the portion substantially near and along the diameter of the cold end, particularly the almost center portion of the cold end is not deformed and remain stationary.

Therefore, if a stationary point is set onto the stationary area of the cold end, and a given article is cooled by utilizing the stationary point, the article can be cooled up to an extremely low temperature with isolation of vibration to the article.

BRIEF DESCRIPTION OF THE DRAWINGS

For better understanding of the present invention, reference is made to the attached drawings, wherein.

DESCRIPTION OF THE PREFERRED EMBODIMENTS

Figure 1:
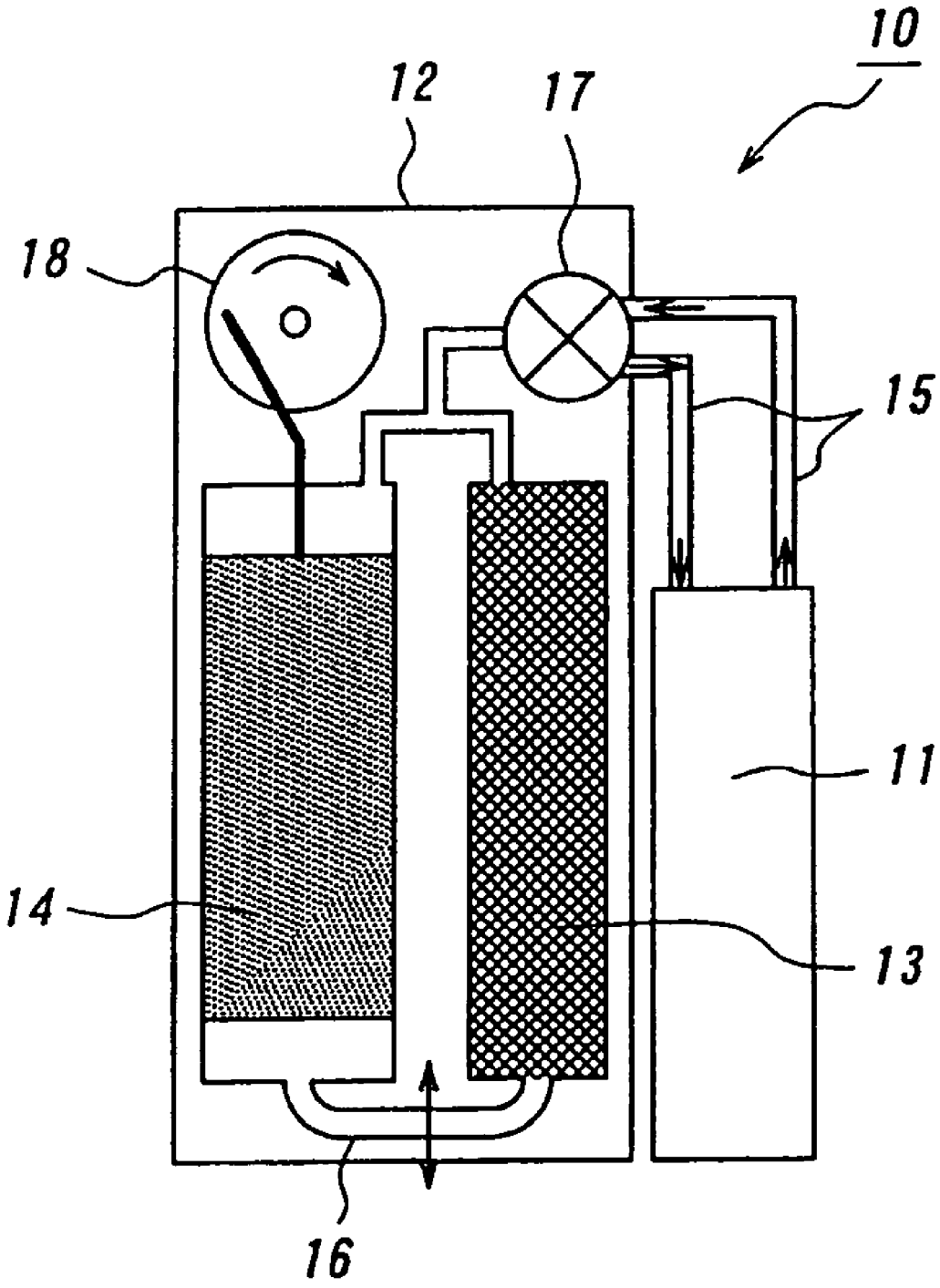
FIG. 1 PRIOR ART
FIG. 1 is a structural view schematically illustrating a conventional GM (Gifford McMahon) type cryocooler.
Figure 2:
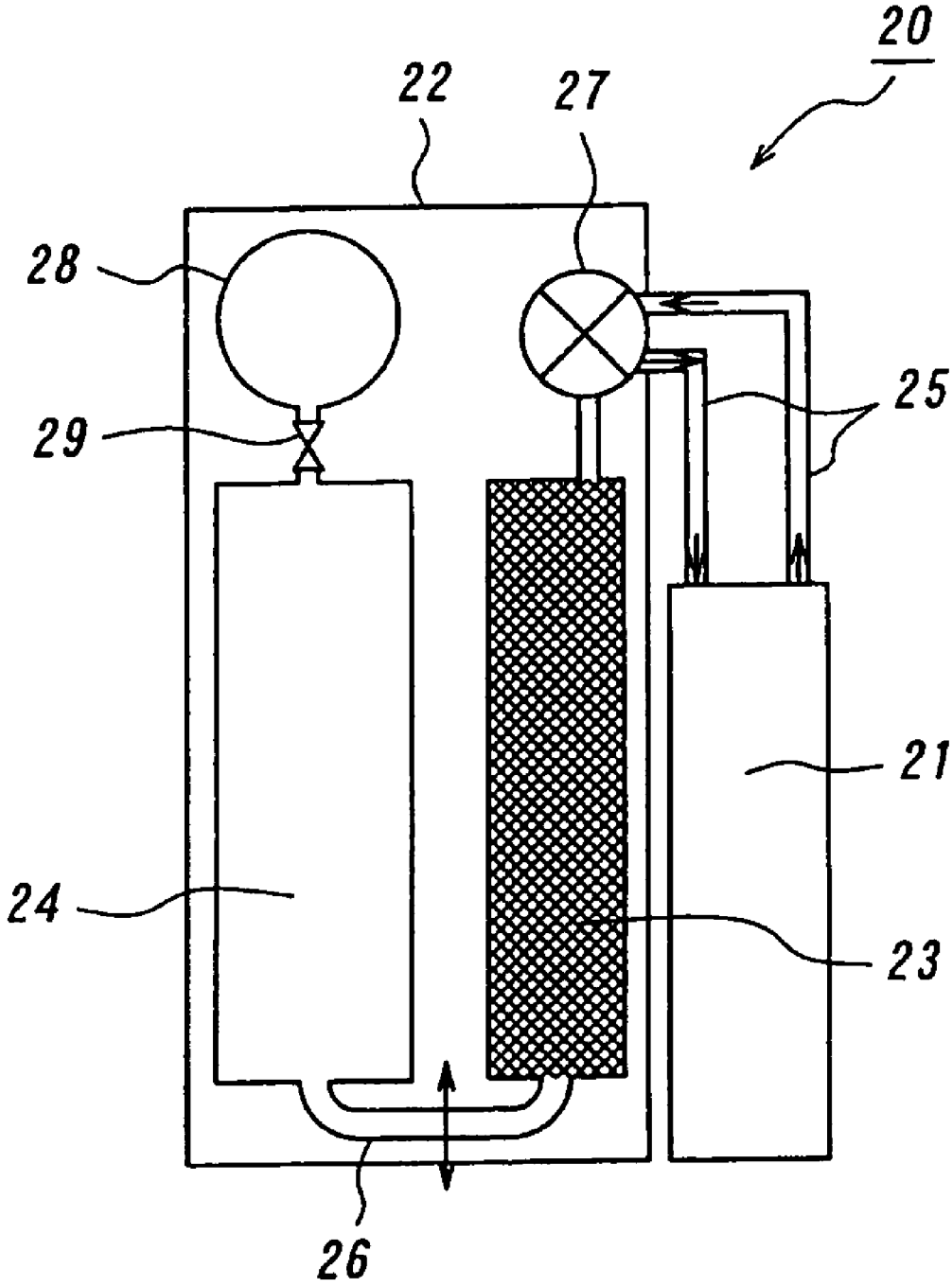
FIG. 2 PRIOR ART
FIG. 2 is a structural view schematically illustrating a conventional pulse tube type cryocooler, FIG. 3 relates to imaging views illustrating the deformation of the cold end of the cryocooler of the present invention.
Figure 3:
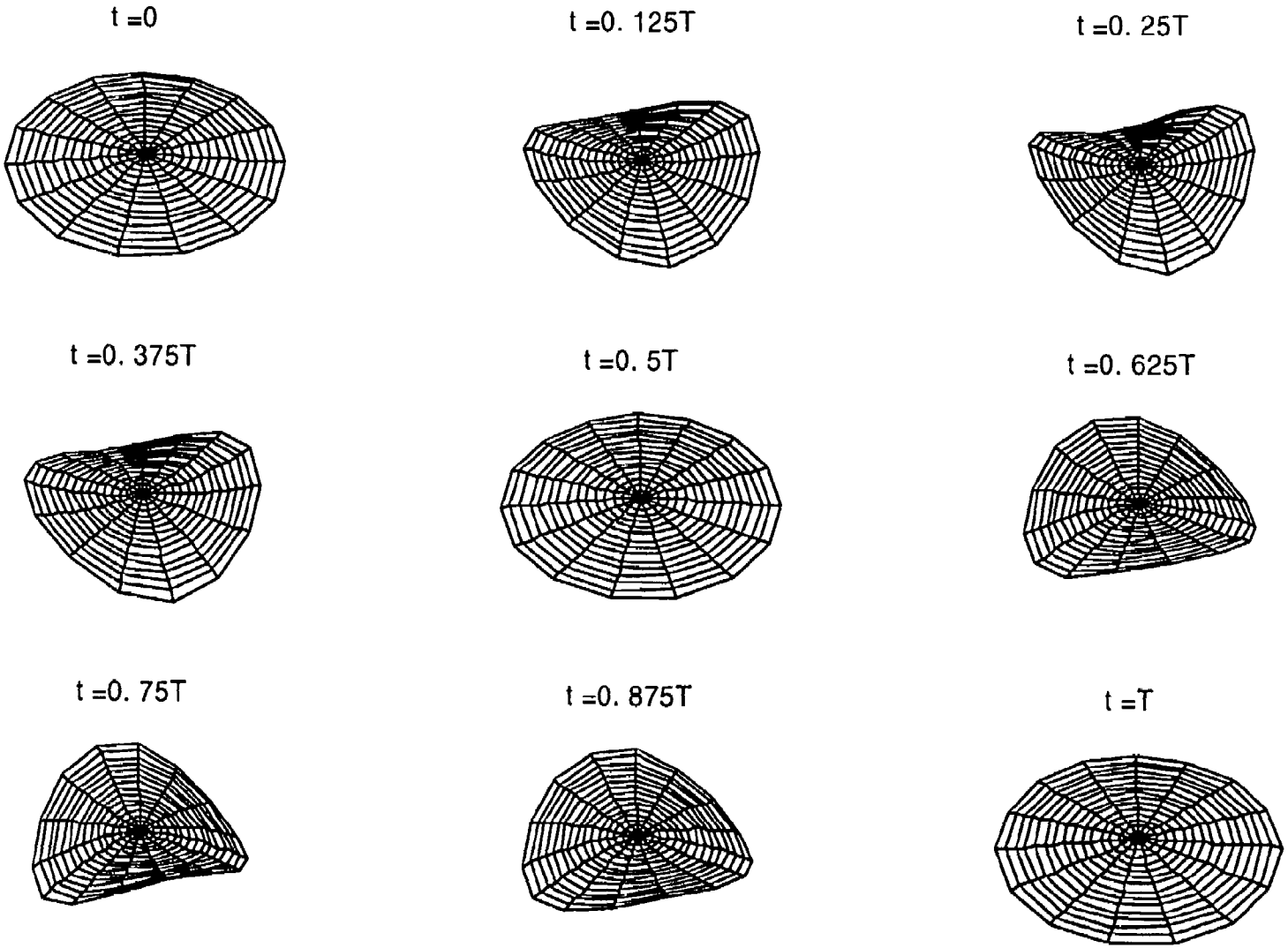
Figure 4:
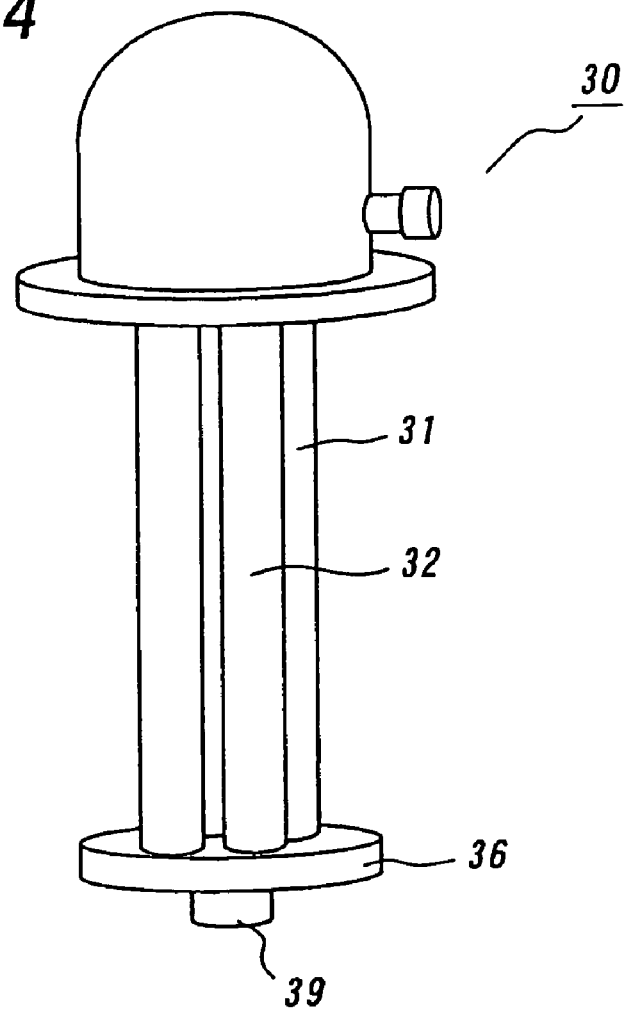
FIG. 4 is a structural view illustrating a cold end of a cryocooler according to the present invention.
Figure 5:
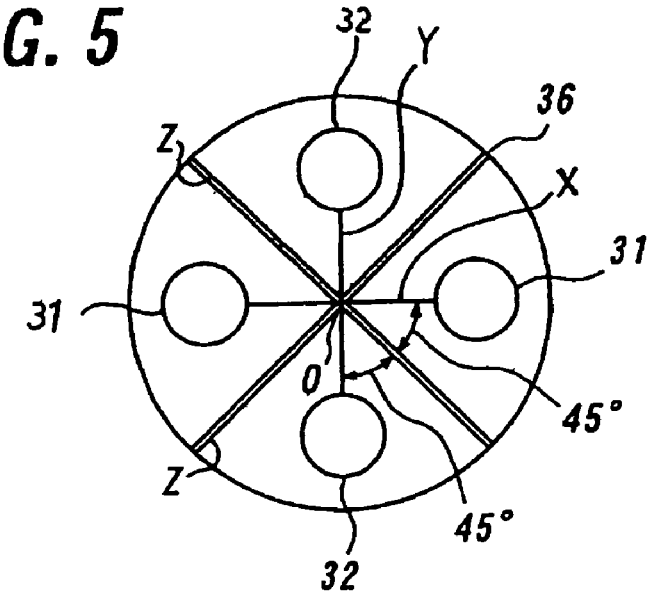
FIG. 5 is a structural view illustrating the connection of the cooling cylinder of the cryocooler illustrated in FIG. 4 to the cold end thereof.

This invention will be described in detail with reference to the accompanying drawings. FIG. 4 is a structural view illustrating a cold end of a cryocooler according to the present invention, and FIG. 5 is a structural view illustrating the connection of the cooling cylinder of the cryocooler illustrated in FIG. 4 to the cold end thereof. In FIG. 4, a compressor is omitted and only the cryocooler cold head is drawn.

The cryocooler cold head 30 illustrated in FIG. 4 includes two pairs of cooling cylinders 31, 32 and a cold end 36 which is provided at the bottoms of the cooling cylinders 31 and 32 so as to be connected with the cooling cylinders 31 and 32.

As illustrated in FIG. 5, the cooling cylinders 31 and 32 are connected with the cold end 36 so that the diagonal line X connecting the cooling cylinders 31 is orthogonal to the diagonal line Y connecting the cooling cylinders 32. A high pressure gas is supplied to the cooling cylinders 31, and a low pressure gas is supplied to the cooling cylinders 32. In this case, the portion of the cold end 36 to which the high pressure gas is applied is deformed downward, and the portion of the cold end 36 to which the low pressure gas is applied is deformed upward.

However, the area near and along the diameter Z between the upward and the downward deformed portions of the cold end 36 is not almost deformed, and particularly, the center O of the cold end 36 is not almost deformed. Therefore, a stationary point can be set onto the area near and along the diameter Z. In the cryocooler 30 illustrated in FIG. 4, a mounting pedestal is formed at the center O of the cold end 36 as the stationary point. Therefore, if a given article is mounted on the mounting pedestal 39, the article can be cooled almost with isolation of vibration to the article.

If the gas supply cycle to the cooling cylinders 31 is shifted from the gas supply cycle of the cooling cylinders 32 by a phase shift of 180 degrees and the cold end 36 is made by thick and rigid material such as tungsten carbide, the cold end 36 itself can not be vibrated. In this case, the stationary point can be set onto any portion of the cold end 36.

Although the present invention was described in detail with reference to the above examples, this invention is not limited to the above disclosure and every kind of variation and modification may be made without departing from the scope of the present invention.

According to the present invention can be cooled an article such as a high performance precise instrument up to an extremely low temperature with isolation of vibration to the article.

What is claimed is:

1. A method for cryocooling a vibration-sensitive article using a regenerative cryocooler, comprising the steps of:

providing a regenerative cryocooler having at least two pairs of cooling cylinders being arranged on and connected to a single main surface of a cold end of the cryocooler, the two pairs of cooling cylinders comprised of four cooling cylinders having the same diameter and the same length and arranged parallel to each other, the two pairs of cooling cylinders are arranged such that the two cooling cylinders of each pair are placed opposite to each other behind a center of the main surface of the cold end, and a diagonal line connecting one pair of cooling cylinders is orthogonal to another diagonal line connecting the other pair of cooling cylinders, and the two cooling cylinders of each one pair are comprised of a pulse tube and a regenerator, the cryocooler cyclically supplying a high pressure gas to the one pair of cooling cylinders and a low pressure gas to the other pair of cooling cylinders, the two pairs of cooling cylinders presenting a pressure phase-shift with respect to one another, so that the cold end is forced to deform at two portions connected to the one pair of cooling cylinders by an extension of the one pair of cooling cylinders with the high pressure gas to an elongating direction of the cooling cylinders, while the cold end is forced to deform at another two portions connected to the other pair of cooling cylinders by a contraction of the other pair of cooling cylinders with the low pressure gas to the opposite elongating direction of the cooling cylinders, to establish a vibration-free portion on the main surface of the cold end of the cryocooler; and mounting the vibration-sensitive article onto a mounting pedestal placed to the vibration-free portion of the cold end.

2. The cryocooling method as defined in claim 1, wherein the main surface of the cold end is formed in a circular shape, and the vibration-free portion is established in an area substantially near and along a diameter of the main surface of the cold end.

3. The cryocooling method as defined in claim 2, wherein the vibration-free portion is established at a center of the main surface of the cold end.

4. The cryocooling method as defined in claim 1, further comprising the steps of:

shifting a supply cycle of the high pressure gas from another supply cycle of the low pressure gas by a phase shift of 180 degrees; and making the cold end of rigid material, such that the vibration-free portion is established over the main surface of the cold end.

5. A regenerative cryocooler for cryocooling a vibration-sensitive article, comprising:

a cold end, at least two pairs of cooling cylinders being arranged on and connected to a single main surface of the cold end, wherein the two pairs of cooling cylinders are comprised of four cooling cylinders having the same diameter and the same length and arranged parallel to each other, the two pairs of cooling cylinders are arranged such that the two cooling cylinders of each pair are placed opposite to each other behind a center of the main surface of the cold end, and a diagonal line connecting one pair of cooling cylinders is orthogonal to another diagonal line connecting the other pair of cooling cylinders, and the two cooling cylinders of each one pair are comprised of a pulse tube and a regenerator; and a mounting pedestal for the vibration-sensitive article is placed to a vibration-free portion on the single main surface of the cold end, wherein a high pressure gas is to be cyclically supplied to one pair of cooling cylinders and a low pressure gas is to be cyclically supplied to the other pair of cooling cylinders, and wherein the two pairs of cooling cylinders present a pressure phase-shift with respect to one another, such that the cold end is forced to deform at two portions connected to the one pair of cooling cylinders by an extension of the one pair of cooling cylinders with the high pressure gas to an elongating direction of the cooling cylinders, while the cold end is forced to deform at another two portions connected to the other pair of cooling cylinders by a contraction of the other pair of cooling cylinders, with the low pressure gas to the opposite elongating direction of the cooling cylinders, to establish a vibration-free portion on the main surface of the cold end.

6. The regenerative cryocooler as defined in claim 5, wherein the main surface of the cold end is formed in a circular shape and the vibration-free portion is established in an area substantially near and along a diameter of the main surface of the cold end.

7. The regenerative cryocooler as defined in claim 6, wherein the vibration-free portion is established at the center of the main surface of the cold end.

8. The regenerative cryocooler as defined in claim 7, wherein the cold end is made of rigid material, and a supply cycle of the high pressure gas is shifted from another supply cycle of the low pressure gas by a phase shift of 180 degrees so that the vibration-free portion is established over the main surface of the cold end.

* * * * *